US007232031B2

(12) United States Patent
Draghetti

(10) Patent No.: US 7,232,031 B2
(45) Date of Patent: Jun. 19, 2007

(54) METHOD FOR PACKING CIGARETTES IN SOFT PACKETS AS WELL AS THE PACKET OBTAINED

(75) Inventor: Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/332,491

(22) PCT Filed: Jul. 10, 2001

(86) PCT No.: PCT/IB01/01233

§ 371 (c)(1),
(2), (4) Date: Jan. 9, 2003

(87) PCT Pub. No.: WO02/04294

PCT Pub. Date: Jan. 17, 2002

(65) Prior Publication Data

US 2004/0020798 A1 Feb. 5, 2004

(30) Foreign Application Priority Data

Jul. 11, 2000 (IT) ..... BO2004A0420

(51) Int. Cl.
*B65D 85/10* (2006.01)

(52) U.S. Cl. ..... 206/273; 493/94

(58) Field of Classification Search ..... 206/242, 206/245, 265, 268, 271, 273; 53/411, 415, 53/416, 419, 424; 229/87.13, 160.1; 493/22, 493/29, 62, 94, 110
See application file for complete search history.

(56) References Cited

U.S. PATENT DOCUMENTS 2,147,411 A * 2/1939 McCracken ..... 229/87.13
2,911,092 A * 11/1959 Micciche ..... 206/273
3,273,780 A * 9/1966 Chalmers ..... 229/87.13
4,225,040 A * 9/1980 Focke et al. ..... 206/273
4,294,642 A * 10/1981 Focke et al. ..... 206/273
4,508,218 A * 4/1985 Focke et al. ..... 206/271
5,035,935 A 7/1991 Thomas et al.
5,788,065 A * 8/1998 Focke ..... 206/271

(Continued)

FOREIGN PATENT DOCUMENTS

GB 831628 3/1960

*Primary Examiner*—Luan K. Bui
(74) *Attorney, Agent, or Firm*—Timothy J. Klima

(57) ABSTRACT

In a method for packing groups (3) of cigarettes (4) in soft packets (1) comprising a single wrap (2) consisting of a single blank (18) comprising a first length (20) of wrapping material printed with a first graphical design (D) and a second length (21) of the same wrapping material printed to look like a metal foil or of another material, juxtaposed and sealed along corresponding join portions (22, 23), the first and second lengths (20, 21) are made by feeding two webs (25) and (36) of the aforementioned wrapping materials presenting, respectively, a longitudinal portion (28) printed to look like a metal foil, and then overlapping and sealing the two portions (27, 28) along the join portions (22, 23) so as to make a single sealed web (37) which is then cut transversely into separate blanks (18), each of which is folded and wrapped around a group (3) of cigarettes (4) in such a way as to place the join and seal portions (22, 23) along a defined perimetric portion (24) of the packet (1) adjacent to its top face (17).

16 Claims, 2 Drawing Sheets

U.S. PATENT DOCUMENTS 5,876,317 A 3/1999 Sigrist et al.
5,931,292 A 8/1999 Focke et al.
5,979,648 A * 11/1999 Focke et al. ..... 206/273
6,276,600 B1 * 8/2001 Rigby ..... 206/273

* cited by examiner 29
57
19
25
34
P1
42
41
30
33
P1
D
49
23
50
43
35
34
26
35
37
34
32
33
39
47
D
40
34
P2
36
48
22
27
30
46
45
35
46'
30
45'
31
44
33
30
38
D
32
51
52
P1
34
28
30
34
56
D
18
20
2
1
21b
21
20b
41
3
8
5
3
7
4
2
1
4
D
55
53
23
22
42
19
54
9
6
7
5
6

METHOD FOR PACKING CIGARETTES IN SOFT PACKETS AS WELL AS THE PACKET OBTAINED

This application is the National Phase of International Application PCT/IB01/01233 filed Jul. 10, 2001 which designated the U.S. and that International Application was published under PCT Article 21(2) in English.

TECHNICAL FIELD

The present invention relates to a method for packing cigarettes in soft packets. The invention can be advantageously applied to machines for making packets of cigarettes, to which the specification below refers but without thereby restricting the scope of the invention.

BACKGROUND ART

Normally, soft cigarette packets have a substantially parallelepipedal shape and consist of a first, complete inner wrap made of paper or metallised paper (foil), placed right around a group of cigarettes, also parallelepipedal in shape, and a second, outer wrap or label.

The second wrap is made from a length of wrapping material, usually paper, having two longitudinal edges and placed partly around the first wrap in such a way as to leave the top face of the latter free, to form the front, the rear and the two sides of the packet, and is also folded at the bottom of the first, inner wrap to form the bottom of the packet.

Once the second wrap or label has been folded around the first wrap, the label presents a free longitudinal edge extending along a defined perimetric portion transversal to the packet and adjacent to its top face, made of foil.

Normally, there is a revenue stamp applied in such a way as to straddle the top of the inner wrap, with its two ends glued at the top edge of the label.

The surface of the label is designed to be visible and is usually printed with decorative patterns and logos, forming a distinctive coloured graphical design, identifying the brand and the organoleptic properties of the cigarettes inside the packet.

Lastly, cigarette packets of this type are usually also wrapped and sealed with a protective overwrap made from transparent plastic film, for example, polypropylene, equipped with a tear strip designed to enable the overwrap to be easily torn in order to gain access to the outer wrap to open the packets.

The packing machines used to make the soft packets described above essentially comprise a packing line along which the preformed groups of cigarettes are fed to a packing station where a corresponding length of paper or metallised paper is folded and wrapped around each group of cigarettes to form the inner wrap. Next, each group of cigarettes enclosed by the first wrap is fed to a second packing line where a corresponding label is folded around the first wrap enclosing the group of cigarettes. When the packing operations have been completed, and the revenue stamp has been applied, the soft packets are usually fed to another machine which wraps and seals each single packet with the protective overwrap made of transparent plastic film.

Soft cigarette packets consisting of a single wrap are also known. The single wrap presents a printed section with a well-defined coloured graphical design constituting the label and designed to wrap the four lateral surfaces and one bottom of a group of cigarettes, and a second section having the appearance of metal foil designed to cover the top of the cigarette group. Packets of this kind have obvious economic advantages not only because they save wrapping material but also because the packing machines used to make them are much simpler than the conventional machine described above.

Further, U.S. Pat. No. 4,508,218 discloses a soft packet consisting of a single, one-piece blank, also presenting a first printed section constituting the label and designed to wrap the four lateral surfaces and one bottom of a group of cigarettes, and a second section having the appearance of metal foil and designed to cover the top end of the cigarette group.

At the line dividing the first section from the second, and along its full length, the blank has a Z-fold made by folding by 180° over each other two longitudinal portions of the blank at said dividing line and placing them over one another to form a reinforced portion along the dividing line itself. Once the blank made in this way is folded and wrapped around the cigarette group, the reinforced portion is located at and adjacent to the top of the packet right around its transversal perimeter. This type of Z-fold, besides strengthening the packet, also simulates the presence of an inner wrap and gives the packet the appearance of a traditional soft packet with two wraps.

Obviously, the blank of wrapping material used to make this type of packet must be considerably wider than a blank that does not have a Z-fold of the this kind. This means that a considerable amount of additional material is required, thus significantly increasing production costs.

DISCLOSURE OF THE INVENTION

The present invention has for an object to provide a soft packet made from a single wrap capable of simulating the presence of inner and outer wraps to make it look like a traditional soft packet with two wraps, and requiring less paper wrapping material than the single-wrap packets taught by prior art, described briefly above, while at the same time having portions which reinforce the packet itself.

Another object of the present invention is to be able to use in a simple and cost-effective manner the packing machines of simplified type to carry out all the stages in the production of the packet.

Accordingly, the invention provides a method for packing cigarettes in soft packets comprising a single wrap having a first section constituting the label and partially wrapping a corresponding group of cigarettes, of a substantially parallelepipedal shape, to form the front, rear, two sides and bottom of the packet, and a second section which wraps the rest of the cigarette group to form the top face of the packet; the method being characterised in that it comprises the following steps: feeding along a first portion of a packing machine a first and a second web of wrapping material; overlapping and sealing the first web to the second web along corresponding join portions so as to obtain a single sealed web; cutting the sealed web transversely into separate blanks, each one forming a single wrap of the packet; and folding and wrapping each single blank around a corresponding group of cigarettes to make a soft, single-wrap packet.

The present invention also relates to a soft, single-wrap packet.

Accordingly, the invention provides a soft cigarette packet comprising a single wrap of wrapping material having a first section constituting the label and partially wrapping a corresponding group of cigarettes, of a substantially parallelepipedal shape, to form the front, rear, two sides and bottom of the packet, and a second section which wraps the rest of the cigarette group to form the top face of the packet, the first section being delimited by the second section along a defined perimetric portion adjacent to the packet top; the packet being characterised in that the single wrap consists of a single blank comprising a first length and a second length of wrapping material obtained from a first and a second web of wrapping material; the first length being juxtaposed and sealed to the second length along corresponding join and seal portions which, when the packet is finished, are located along the aforementioned perimetric portion adjacent to the top face of the packet The invention will now be described with reference to the accompanying drawings, which illustrate preferred embodiments of it and in which:

Figure 1:
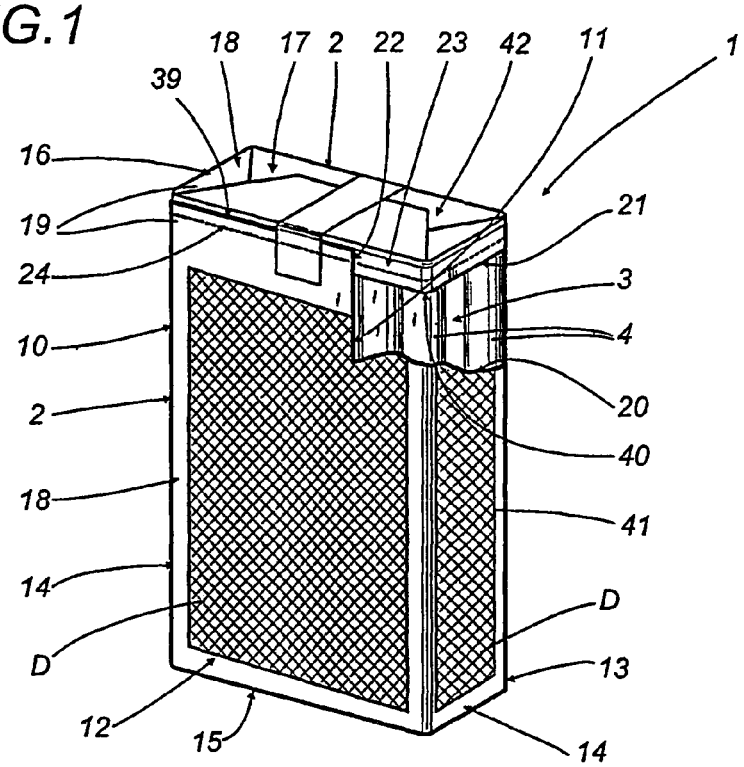
FIG. 1 is a perspective representation, with some parts cut away for clarity, of a soft packet with a single-wrap, made according to the present invention.
Figure 4:
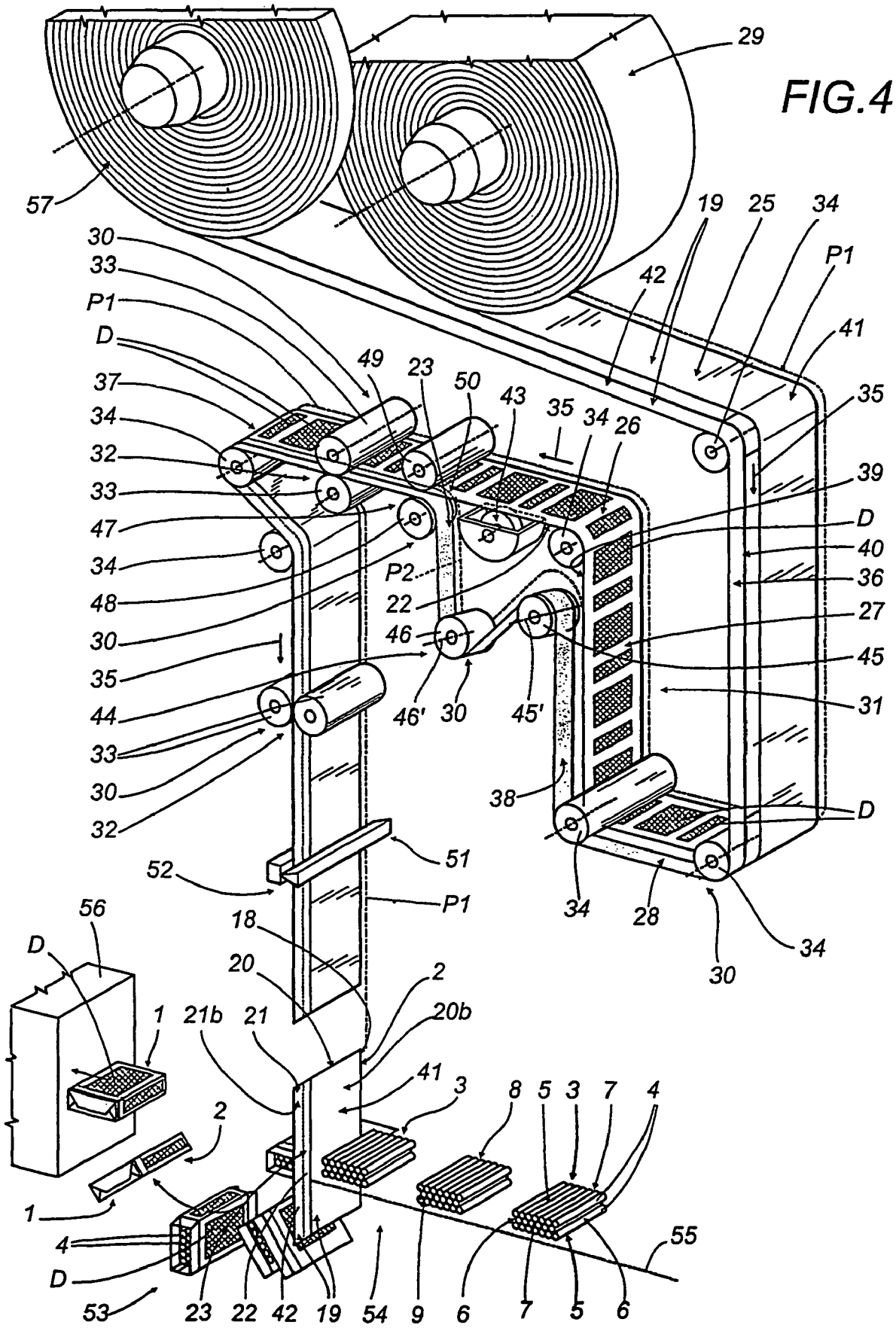
FIG. 4 is a schematic, perspective representation of a preferred embodiment of a portion of a wrapping machine capable of making the wrap shown in FIG. 2 and the soft packet shown in FIG. 1.

With reference to FIG. 1, the numeral 1 denotes in its entirety a soft packet consisting of a single wrap 2 designed to receive a group 3 of cigarettes 4. As shown in FIG. 4, each group 3 of cigarettes 4 is substantially parallelepipedal in shape and has two large lateral faces 5, opposite and parallel to each other, two small lateral faces 6, opposite and parallel to each other and adjacent to the two faces 5, and two end faces 7, opposite and parallel to each other and forming a bottom 8 and a top 9 of the group 3 itself.

The packet 1 presents a first printed section 10, which constitutes the so-called label 11, which is wrapped around the group 3 of cigarettes 4 to cover the lateral faces 5, 6 and the bottom 8 but not the top 9, so as to form a front 12, a rear 13, two sides 14 and a bottom 15 of the packet 1, and a second section 16 that looks like metal foil which is wrapped around the top 9 of the group 3 to form a top face 17 of the packet 1.

Figure 2:
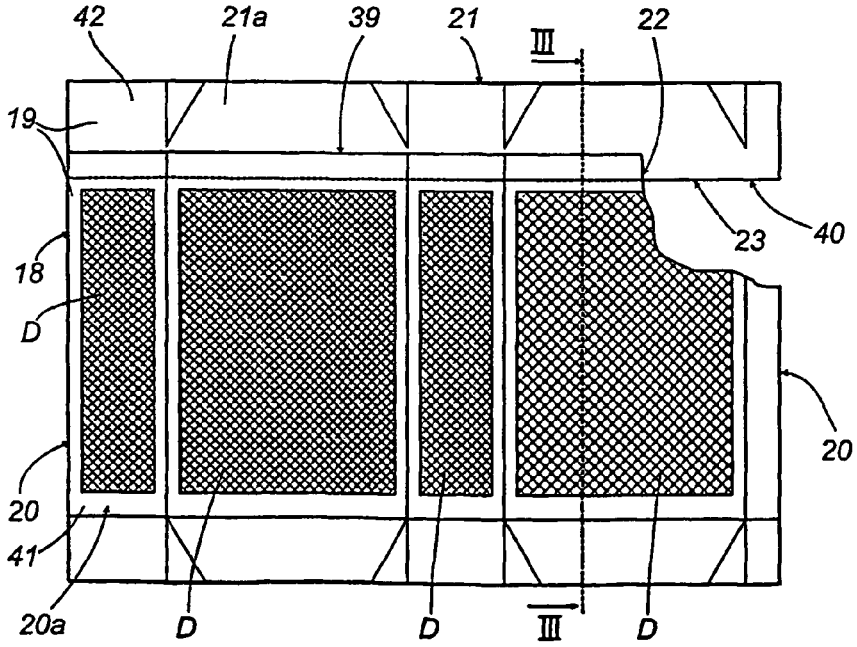
FIG. 2 is a plane development of the wrap shown in FIG. 1.
Figure 3:
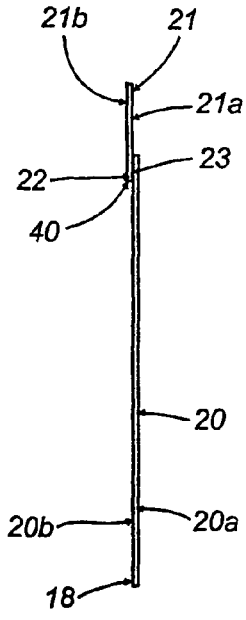
FIG. 3 is a cross section through line III—III of the wrap shown in FIG. 2.

As shown in FIGS. 2, 3, and 4, the single wrap 2 of each packet 1 is made by wrapping and appropriately folding around a group 3 of cigarettes 4 a single blank 18 of wrapping material, which may be either the same type of wrapping material 19, in which case the single blank 18 consists of a first and a second length 20, 21 of the same type of wrapping material 19, or with two different types of wrapping materials, denoted first wrapping material 41 and second wrapping material 42. Whichever the case, the first and second-lengths 20, 21 partly overlap and are joined to each other and sealed along the defined join and seal portions 22, 23.

As shown in FIGS. 2 and 3, the first length 20 has an outside surface 20*a*, which, when the packet 1 has been made, is the one that is visible and opposite the inside surface 20*b* which comes into direct contact with the group 3 of cigarettes 4. The outer surface 20*a* has printed on it a series of decorative patterns and a series of logos with a particular graphic form, constituting a defined graphic design, schematically represented in the drawings as cross-hatching, labelled D. Instead, if the second length 21 is made from the same type of wrapping material 19 as the first length 20, its outside surface 21*a*, opposite the inside surface 21*b* that comes into direct contact with the cigarettes 4, is printed to look like metal foil, whereas, if it is made from a wrapping material 42 that is different from the wrapping material 41 from which the length 20 is made, the second length is made, for example, of metallised material 19 such as foil.

The first length 20 is used to wrap the four lateral faces 5, 6 and the end face 7 forming the bottom 8 of a corresponding group 3 of cigarettes, to constitute a corresponding label 11 for the wrap 2 and hence for the resulting packet 1 obtained when the blank 18 has been completely wrapped around the group 3, while the second length 21 is used to wrap the other end face 7 forming the top 9 of the group 3, to constitute the top face 17 of the wrap 2 and hence of the resulting packet 1.

As shown in FIG. 1, once the packet 1 has been completed, the aforementioned portions 22, 23 by which the length 20 is joined and sealed to the second length 21, are located along a defined perimetric portion of the packet 1, schematically represented, for the sake of clarity only, by the dot-dashed line labelled 24, adjacent to the top face 17 and extending parallel to the four edges of the top face 17 itself.

As shown in FIG. 4, each single blank 18, forming a single wrap 2 of a packet 1, is made from two separate webs of wrapping material, namely, a first and a second web, labelled 25 and 36, respectively.

In one embodiment, the two webs 25 and 36, are made from the same type of wrapping material, labelled 19, and in this case, the first web 25 has on its surface 26 a corresponding longitudinal portion 27 printed with the aforementioned graphic design D and forming the outside face 20*a* of the first length 20, while the second web 36 has on its surface 38 a second longitudinal portion 28 of the same type of wrapping material uniformly printed to look like metal foil and forming the outside surface 21*a* of the second length 21.

In another embodiment, the two webs 25 and 36 are made from two different types of wrapping materials, that is to say, the web 25 is made from a first type of wrapping material, labelled 41 and having on its surface 26 a corresponding longitudinal portion 27 printed with the aforementioned graphic design D and forming the outside face 20*a* of the first length 20, while the second web 36 is made from a second type of wrapping material, labelled 42 and consisting of metallised material or foil.

The web 25 is unwound from a roll 29 and the web 36 from a roll 57 and are fed along a first feed path P1 through a unit 30 forming part of a first portion 31 of an automatic packing machine which is not illustrated.

In the generic embodiment illustrated in FIG. 4, the unit 30 comprises a first and a second device 32 for feeding the webs 25 and 36, each of which comprises a pair of parallel, horizontal feed rollers 33, operating in conjunction with each other and located on opposite sides of the path P1, and a plurality of horizontal transfer rollers 34 on which the webs 25 and 36 unwind as they move along the feed path P1 in a feed direction 35 which may vary from one section to another of the path P1 itself.

The two webs 25 and 36 have, respectively, a first longitudinal edge 39 which delimits the first area 27 of the first web 25, and a second longitudinal edge 40 which, in the case of the two wrapping materials 19 of the same type, delimits the second area 28. At the first edge 39 a corresponding portion 22 of the first longitudinal area 27 is thus formed and, similarly, a corresponding portion 23 of the second longitudinal area 28 us formed at the second edge 40. The two portions 22, 23 are subsequently overlapped, joined and sealed to make a single sealed web 37.

Looking in more detail, the web 25, whether it is made of the same type of wrapping material 19 as the web 36, or of a different type of wrapping material 41 from the wrapping material 42 from which the second web 36 is made, always has the first longitudinal area 27 printed with the coloured graphic design D and, in the same way, the second web always has the second longitudinal area 28 that has the uniform appearance of metal foil. At this point, it should be pointed out for clarity that the first and second join and seal portions 22, 23 and, similarly, the edges 39 and 40, are the same whether we consider the first and second longitudinal areas 27, 28 or the first and second webs 25, 36, or whether we consider the first and second length 20, 21 that form the single blank 18 of wrapping material.

Upstream of the first feed device 32, the unit 30 comprises a gumming roller unit 43 of known type, fitted on the first feed path P1 and designed to spread a film of adhesive on the join and seal portion 22 of the first web 25.

Between the feed device 32 and the gumming unit 43, the unit 30 further comprises a diverting unit 44 comprising a first web guide roller 45 which rotates about an axis 45' that is inclined in the direction of the first web 25 towards the edge 39 of the first web 25 itself, and a second web guide roller 46 whose axis 46' is inclined in the direction of the first web 25. The diverting unit 44 is designed to change the feed path of the second web 36, causing it to move along a second feed path P2 that is separate from the first path P1.

For completeness and in order to facilitate the understanding of how the diverting unit 44 works, below is a brief description of what happens at the diverting unit 44 and at the gumming unit 43.

As shown in FIG. 4, after the step of feeding the two webs 25 and 36 along the same path P1, the second web 36, as it moves along the second path P2, first encounters the first roller 45 which moves it closer to the first web 25, and then the second roller 46, which makes it converge on a station 50 that juxtaposes it with the first web 25 in such a way as to place the second web 36 in contact with the first web 25 at the corresponding join portions 22 and 23.

At the station 50, the unit 30 is equipped with an aligning unit 47 comprising a third web guide roller 48 and a counter-roller 49, both horizontal and acting in conjunction with each other on opposite sides of the first path P1. The third roller 48 is designed to receive the second web 36, which moves over it, and to align the second feed path P2 of the second web 36 with the first feed path P1 of the first web 25, in such a way as to place the portion 23 of the second web 36 in contact with the portion 22 of the first web 25, on which the gumming unit 43 previously spread a film of adhesive. It follows, therefore, that the diverting unit 44 and the aligning unit 47 allow the juxtaposition and sealing of the first longitudinal area 27, which has printed on it the coloured graphic design D, with the second longitudinal area 28, which is printed to look like metal foil, so as to form a single web 37 sealed along the corresponding join and seal portions 22 and 23 of the first and second longitudinal areas 27, 28.

Looking in more detail, the counter-roller 49 presses the portion 22 of the first web 25 on the second portion 23 of the second web 36, thus ensuring a perfect seal.

The sealed web 37 proceeds along the path P1 to reach a cutting station 51 comprising a transversal cutting unit 52, of known type, designed to cut the sealed web 37 transversely into separate blanks 18.

The separate blanks 18 are fed cyclically along the path P1 towards a wrapping station 53 of a second portion 54 of the aforementioned packing machine, which is not illustrated, where there is a single wrapping device of known type (not illustrated) capable of folding and wrapping each single blank 18 around each group 3 of cigarettes 4 which has in the meantime reached the wrapping station 53, moving in step with the separate blanks 18 along a group forming line 55, in the second portion 54 of the packing machine, towards the wrapping station 53.

As shown in FIGS. 4 and 1, soft packets 1, consisting of a single wrap 2, are made. In such packets, the first longitudinal edge 39 of the first longitudinal area 27 printed with a defined coloured graphic design D, which is the edge 39 of the first length 20 of wrapping material, and the second longitudinal edge 40 of the second longitudinal area 28 printed to look like metal foil, which is the edge 40 of the second length 21 of wrapping material, are overlapped and sealed, and positioned along the aforementioned perimetric portion 24 adjacent to the top face 17 of the packet 1.

As shown in FIG. 1, when each packet 1 has been made, the longitudinal edge 39 of the first length 20 of wrapping material constituting the label is visible and gives the packet the appearance of a traditional soft packet consisting of two wraps.

Moreover, when the packet 1 has been made, the first longitudinal edge 39 of the first length 20 of wrapping material and the second longitudinal edge 40 of the second length 21 of wrapping material, being overlapped and sealed to each other all the way around the aforementioned perimetric portion 24 adjacent to the top face 17 of the packet 1, constitute a reinforcement of the wrapping material which strengthens the corresponding portion of the packet 1 itself. The finished packets 1 are then fed to another machine of known type, schematically represented by a block 56. The operation of the unit 30 can be clearly inferred from the above description and is therefore not described in any more detail.

The invention claimed is:

1. A method for packing cigarettes in soft packets comprising a single wrap consisting of a first section and a second section, the first section constituting the label and partially wrapping a corresponding group of cigarettes, of a substantially parallelepipedal shape, to form a front, rear, two sides and bottom of the packet, the second section wrapping the rest of the group of cigarettes to form a top face of the packet; the method comprising: feeding along a first portion of a packing machine a first and a second web of the same type of single ply paper wrapping material; overlapping and sealing the first web to the second web in a single layer each along corresponding join portions so as to obtain a single sealed web having a single overlapped portion; cutting the sealed web transversely into separate blanks with each blank having only the single overlapped portion, forming a single wrap of the packet from a single blank by folding and wrapping the single blank around a corresponding group of cigarettes to completely enclose the group of cigarettes in a soft packet.

2. The method according to claim 1, wherein the steps of feeding and joining comprise the further steps of feeding the first web of paper wrapping material, having a corresponding longitudinal edge, and the second web of paper wrapping material, having a corresponding longitudinal edge along at least one first defined feed path: gumming at least the first or the second web at the corresponding join portion; overlapping and sealing the first longitudinal edge of the first web to the second longitudinal edge of the second web at the join portions to form a single sealed web.

3. The method according to claim 1, wherein the joining step comprises the further step of feeding the first or the second web along the feed path; feeding the other web, whether the first or the second along a second feed path which is separate from the first path; gumming at least the first or the second web at the corresponding join portion; using diverting means, located in the operating unit, to dived the first or the second web and cause it to converge on a station which juxtaposes it with the other web, whether the first or the second in such a way as to place the two webs in contact with each other at the corresponding join portions; and using aligning means, located in the operating unit, to align the second feed path with the first feed path in such a way as to enable the first web and the second web of paper wrapping material to be juxtaposed with and sealed to each other.

4. The method according to claim 1, where the first web includes on at least one outside surface of it a corresponding longitudinal area printed with a defined colored graphic design, and the second web includes on at least one outside surface of it a corresponding longitudinal area that is uniformly printed in metallic color.

5. The method according to claim 4, wherein, after the step of transversely cuffing the sealed web into separate blanks, each single blank comprises a first and a second length of the same type of paper wrapping material which are overlapped and sealed along the join portions; the first length having printed on it a defined colored graphic design, and the second length being uniformly printed in metallic color.

6. The method according to claim 5, wherein the step of folding and wrapping each single blank around a corresponding group of cigarettes comprises a further step of positioning at a defined perimetric portion of the packet adjacent to its top face the portions, by which the first length and the second length are joined to each other.

7. The method according to claim 1, wherein the folding and wrapping step comprises the further steps of cyclically feeding the single blanks to a wrapping station forming part of a second portion of the packing machine, and designed to fold and wrap each single blank around each group of cigarettes to form a soft packet with a single wrap.

8. The method according to claim 1, wherein the step of feeding the first and second webs comprises the further step of unwinding the first web from a corresponding first roll and the second web from a corresponding second roll.

9. A soft packet comprising a single wrap of wrapping material consisting of a first section and a second section joined together, the first section constituting a label and partially wrapping a corresponding group of cigarettes, of a substantially parallelepipedal shape, to form a front, rear, two sides and bottom of the packet, the second section wrapping the rest of the group of cigarettes to form a top face of the packet such that the single wrap completely encloses the group of cigarettes, the first section, which constitutes the label, being delimited by the second section along a defined perimetric portion of the packet adjacent to the top face, wherein the single wrap is formed from a single blank consisting of a first and a second length of the same type of single ply paper wrapping material obtained from corresponding first and second webs of the same type of single ply paper wrapping material; the first length being juxtaposed with and sealed to the second length in a single layer each along corresponding join and seal portions such that the single blank has a single overlapped portion which, when the packet has been completed, is positioned along the defined perimetric portion adjacent to the top face.

10. The packet according to claim 9, wherein the first length of paper wrapping material constitutes the label and the second length of paper wrapping material constitutes the top face; the first and second lengths being made by feeding along a defined feed path in a first portion of a packing machine the first web, which has a corresponding longitudinal edge, and the second web, which has a corresponding longitudinal edge.

11. The packet according to claim 9, wherein the first length of paper wrapping material is overlapped with and sealed to the second length of paper wrapping material along the perimetric portion adjacent to the top face following corresponding packaging steps during which at least the first or the second longitudinal edge is gummed at the corresponding join portion and during which the first longitudinal edge of the first web is overlapped with and sealed to the second longitudinal edge of the second web at the corresponding defined join portions to form a single sealed web.

12. The packet according to claim 11, wherein each single wrap is made by transversely cutting the single sealed web into separate blanks, each forming a single wrap of the packet.

13. The packet according to claim 9, where the first length has printed on it a defined colored graphic design to form the label and being obtained from the first web that has on at least one surface of it a corresponding longitudinal area printed with the colored graphic design, and the second length is uniformly printed in metallic color to form the top face and being obtained from the second web that has on at least one outside surface of it a corresponding longitudinal area that is uniformly printed in metallic color.

14. The packet according to claim 11, where the first length has printed on it a defined colored graphic design to form the label and being obtained from the first web that has on at least one surface of it a corresponding longitudinal area printed with the colored graphic design, and the second length is uniformly printed in metallic color to form the top face and being obtained from the second web that has en at least one outside surface of it a corresponding longitudinal area that is uniformly printed in metallic color.

15. The packet according to claim 14, wherein the first longitudinal edge of the first longitudinal area, which has pnnted on it a defined colored graphic design of the first web, and the second longitudinal edge of the second longitudinal area, being printed in metallic color, are positioned, once overlapped and sealed, along the defined perimetric portion adjacent to the top face, in such a way that the longitudinal edge of the first area constituting the label is visible and gives the packet the appearance of a traditional soft packet having two wraps.

16. The packet according to claim 15, wherein the first longitudinal edge and the second longitudinal edge, being overlapped and sealed to each other all the way around the aforementioned perimetric portion adjacent to the top face, constitute a reinforcement of the wrapping material which strengthens the packet itself.

* * * * *